US010676940B2

(12) United States Patent
Fulbrook

(10) Patent No.: US 10,676,940 B2
(45) Date of Patent: Jun. 9, 2020

(54) SHOE MOULDING TO FINISH INTERIOR DOORWAY

(71) Applicant: Jim E Fulbrook, Fairfax, VA (US)

(72) Inventor: Jim E Fulbrook, Fairfax, VA (US)

( * ) Notice: Subject to any disclaimer, the term of this patent is extended or adjusted under 35 U.S.C. 154(b) by 0 days.

(21) Appl. No.: 16/498,352

(22) PCT Filed: Jan. 15, 2019

(86) PCT No.: PCT/US2019/013715
§ 371 (c)(1),
(2) Date: Sep. 26, 2019

(87) PCT Pub. No.: WO2019/143639
PCT Pub. Date: Jul. 25, 2019

(65) Prior Publication Data

US 2020/0040592 A1 Feb. 6, 2020

Related U.S. Application Data

(60) Provisional application No. 62/709,331, filed on Jan. 16, 2018.

(51) Int. Cl.
*E04F 19/04* (2006.01)
*E06B 1/34* (2006.01)

(52) U.S. Cl.
CPC ..... *E04F 19/04* (2013.01); *E06B 1/34* (2013.01)

(58) Field of Classification Search
CPC ..... E04F 19/04; E06B 1/34; E06B 2001/622
See application file for complete search history.

(56) References Cited

U.S. PATENT DOCUMENTS 3,564,642 A 2/1971 Blackburn
5,203,130 A 4/1993 Freelove
5,775,045 A * 7/1998 Hill ..... E06B 1/34 52/211
9,249,585 B1 * 2/2016 Swindle ..... E04F 19/0495
2006/0282981 A1 12/2006 Speck et al.

* cited by examiner

*Primary Examiner* — Patrick J Maestri
(74) *Attorney, Agent, or Firm* — Invention to Patent Services; Alex Hobson

(57) ABSTRACT

A doorway shoe moulding kit includes shoe moulding pieces that are designed to provide a finished interface between standard interior doorways and flooring in a manner that is aesthetically pleasing and functional. A kit includes pieces that are contour-matched to standard doorway casings, that abut with standard shoe mouldings and that are well fitted to cover the standard door jamb. The doorway shoe moulding kit can be easily adapted to suit a variety of doorway sizes and configurations and it may be tapered to ensure the moulding does not interfere with the operation of a door. The doorway shoe moulding may be easily filed, sanded or cut to best fit it to a doorway, it shall be easily and quickly attached to the doorway, and it shall be readily painted or finished to suit the user.

9 Claims, 17 Drawing Sheets

SHOE MOULDING TO FINISH INTERIOR DOORWAY

CROSS REFERENCE TO RELATED APPLICATIONS

This application is a national stage entry application of PCT application No. PCT/US2019/013715, filed on Jan. 15, 2019, which claims the benefit of priority to U.S. provisional patent application No. 62/709,331 filed on Jan. 16, 2018; the entirety of which is hereby incorporated by reference herein.

BACKGROUND OF THE INVENTION

Field of the Invention

The invention relates to a doorway shoe moulding assembly, kit and method of installation.

Background

In general homes are typically built in the USA wherein standardized, pre-hung and pre-assembled interior doorways are installed with vertical casing and a standardized door jamb. The room is typically finished using a baseboard along the wall and usually a shoe or toe moulding is also used to create a more finished appearance along the floor and baseboard by covering the gap between the components where irregular and uneven edges typically occur. This is especially true when a wood or smooth, hard surface floor is installed with a baseboard and shoe moulding. However, these mouldings are also used to accommodate and finish carpeted flooring as well. The current industry standard for construction is to leave the gap between the floor and doorway unfinished as there are no products in the market that accomplishes this aesthetic application with a clean, finished appearance.

Existing prior art examples include U.S. Pat. No. 6,189,276—Pinto et al, disclosing decorative baseboard molding, U.S. Pat. No. 6,276,101—Schiedegger et al, disclosing surround molding assembly for a doorway structure, U.S. Pat. No. 6,354,057—Poplis—disclosing seamless floor to wall baseboard system, U.S. Pat. No. 8,375,663—Johnston et al, disclosing an integral wall base and flash coves, U.S. Pat. No. 8,973,321—Pelosi, disclosing a two-part floor molding system, U.S. Pat. No. 9,194,137—Williams, disclosing a floor trim molding system, U.S. Pat. No. 9,593,494—Frenette, disclosing a flooring transition strip, and US Publication 2017/0183879—Rossi et al, disclosing a polymeric cove base for flooring systems.

The aforementioned prior art devices such as those disclosed above are adequate for the basic purposes as in the instant invention and are uniformly deficient with their capability to provide a comprehensive, contour-matched, efficient, and aesthetically pleasing appearance for finishing an interior doorway with a shoe moulding that is attached between the doorway and flooring around the vertical casing and door jamb components. There is no prior art that describes a system for finishing an interior doorway with shoe moulding in particular by attaching contour-matched pieces that cover the standard casing types used in doorways. Throughout this Specification disclosure the term "molding" is synonymous with the term "moulding". The industry standard for describing such products is to use the "moulding" spelling.

SUMMARY OF THE INVENTION

The invention is directed to a doorway shoe moulding assembly that is configured to fit around the casing and doorjamb to produce an aesthetically pleasing appearance around the doorway. An exemplary doorway shoe moulding assembly comprises a plurality of detailed contour-matched pieces that cover the doorway casing and door jamb and may abut with standard shoe moulding attached to a baseboard on either side of the doorway. An exemplary doorway shoe moulding makes a continuous finished convex edge around the doorway thereby covering the gaps between the floor and doorway components, which also prevents dirt, debris, and insects from collecting in the unfinished gap or crevasse. An exemplary doorway shoe moulding assembly may be provided in a kit having tailored pieces that fit a standard doorway, pocket or sliding doorway, and the interior side of an exterior doorway. An exemplary doorway shoe moulding kit may comprise a plurality of assemblies to enable quick installation of the doorway shoe moulding assembly around a doorway.

An exemplary doorway shoe moulding assembly of the present invention covers gaps between the casing, doorjamb and the floor. The doorway shoe moulding assembly comprises a casing shoe moulding having a casing surface configured to match the contours of a casing and extends from a wall-end, where it may abut with shoe moulding extended along the wall to a doorway-end where it couples with a jamb shoe moulding. The casing shoe moulding extends along the casing and interfaces with or is coupled to a jamb shoe moulding that extends orthogonally from the casing shoe moulding along the doorjamb. An exemplary doorway shoe moulding assembly may have a first and second jamb shoe moulding configured to couple with a first and second casing moulding, respectively. A spacer shoe moulding may be configured along the doorjamb between the first and second jamb shoe mouldings.

In an exemplary embodiment, the doorway shoe moulding assembly comprises a casing assembly comprising a casing shoe moulding attached to a jamb shoe moulding in a one-piece unit. A casing assembly may be configured for a particular type of casing and doorway and the doorway shoe moulding assembly may be configured in a kit having a first casing assembly for a first side of the doorway and a second casing assembly for a second side of the doorway. A user may fit the first casing assembly to the casing on the first side of the doorway and the second casing assembly to the second side of the doorway to produce a continuous shoe moulding around the doorway. A kit may further include spacers in the event there is a gap between the first and second jamb shoe mouldings. A plurality of different spacers having different lengths may be provided in a kit for the doorway shoe moulding assembly.

In an exemplary embodiment, a doorjamb has a doorstop, or a protrusion that extends out from the jamb to set a stop for the door. The stop is typically rectangular in shape. An exemplary doorway shoe moulding assembly configured for a doorjamb having a doorstop comprises a stop shoe moulding configured to fit around the doorstop and may include a stop shoe moulding portion that extends between two side-stop shoe mouldings that extend orthogonally from the extended ends of the stop shoe moulding portion to produce a shoe moulding that wraps around the doorstop. The stop shoe moulding portion and the two side-stop shoe mouldings may be configured in a stop assembly that is a one-piece unit wherein the stop shoe moulding portion is attached between the two side-stop shoe mouldings. Again, a jamb spacer shoe moulding may be configured between the stop shoe moulding or stop shoe moulding assembly and one or both casing shoe mouldings.

In an exemplary embodiment, a doorway shoe moulding assembly is configured to extend around a pocket door doorway, wherein the pocket door doorway has a pocket door opening for the sliding of the pocket door in and out of the wall. A pocket doorway shoe moulding assembly comprises a casing shoe moulding that extends along a casing on a first side of a doorway and is coupled on a doorway end with a jamb shoe moulding that extends proximal to the pocket door opening. An exemplary pocket doorway shoe moulding may further comprise a second casing shoe moulding extending along a second casing on a second side of the doorway that extends to a second jamb shoe moulding. Again, the second jamb shoe moulding extends from the doorway end of the second casing shoe moulding to the pocket door opening. In some cases, the first or second jamb shoe moulding may extend across the pocket door opening to couple with the opposing jamb shoe moulding to produce a continuous shoe moulding around the doorway to the pocket door opening. A spacer may extend between the two jamb shoe mouldings and across the pocket door opening to produce a continuous shoe moulding around the doorway.

An exemplary casing shoe moulding has a casing surface that is contoured to match and interface with a casing, such as any of the commonly used casing including, but not limited to, CM376, CM366, CM327, CM356, CM442, CM351, CM371, and any other standardized casings. An exemplary casing and therefore a typical casing shoe moulding is about 50 mm or wider, such as about 75 mm wide or more, about 100 mm or more, about 125 mm or more, about 150 mm or more, about 200 mm or more and any range between and including the jamb widths provided. A casing shoe moulding may be configured to match the contours of a custom casing as well. A casing shoe moulding casing surface extends at least along the top of the casing shoe moulding to produce an aesthetically appealing interface along the casing and typically has a flat bottom surface or bottom edge to extend along a floor. An exemplary casing shoe moulding extends along the casing from a wall-end to a doorway-end where it couples with a jamb shoe moulding. The doorway end of a casing shoe moulding may be beveled such as being terminated in a 45 degree angle to form a tight connection with the jamb shoe moulding.

An exemplary jamb shoe moulding extends from a doorway-end of a casing shoe moulding along the jamb, and may extend all the way across the jamb to the opposing casing shoe moulding or only partially along the jamb. An exemplary jamb is typically about 75 mm or wider, such as about 100 mm wide or more, about 125 mm or more, about 150 mm or more, about 200 mm or more and any range between and including the jamb widths provided. An exemplary jamb shoe moulding terminates on the casing-end in a beveled end, such as a 45 degree angle to form a tight coupling with a beveled end of the casing shoe moulding. The opposing end of an exemplary jamb shoe moulding may terminate in a straight edge, an end that is orthogonal to the length of the jamb shoe moulding. This straight edge may make for a tight coupling with another jamb shoe moulding or a spacer shoe moulding, as described herein.

An exemplary doorway shoe moulding assembly may include pieces made out of wood, a composite material, plastic, foam or other suitable materials. An exemplary foam or plastic shoe moulding of the present invention may be injection molded or otherwise formed into the required shapes including the casing surface to fit snugly along the doorway. Shoe moulding pieces may be provided in a variety of colors and may have a solid exterior surface to allow a user to paint the shoe moulding pieces.

The exemplary doorway shoe moulding assembly of the present invention may be glued to the doorway and casing or attached using a fastener, such as a nail, screw, pin or staple. It is to be understood that each of the following assemblies, the casing shoe moulding assembly, the stop shoe moulding assembly and the jamb shoe moulding assembly, which comprise a plurality of pieces that may extend in different direction, are attached together as a one-piece unit prior to installation on the doorway. For example In an exemplary embodiment, the shoe moulding components are sized to precisely fit or contour match against curves and indentations of standard door moulding that have: 1) multi-curved vertical casing profiles, and 2) a standard door jamb of about 116 mm (4 9/16 inches) width that is composed of a doorstop and flat sections where a swinging door would be installed and a longer non-door section opposite of the doorstop.

It is notable that interior multi-curved doorway moulding, casing, for door and window casings come in standardized, industry-coded profiles as shown in FIG. 19. The most common casing sizes or profiles used in construction are either 57 mm (2.25 inches) or 63.5 mm (2.5 inches) long with a depth at the thickest end part of either 15 mm (19/32 inch) or 17.5 mm (11/16 inch) that abuts against the baseboard moulding when installed. The curves of the casing profile typically cascade down to a vertical end piece of the casing that is sized at about 6.35 mm (1/4-inch) width at the doorway corner where it abuts with the door jamb. The casing profiles depicted in FIG. 19 account for over 90% of the market where the CM376 profile is the most frequently used in the industry. Longer casing profiles are in the market, but they will only be available as an invention kit or package by special order.

It is also notable that the standard interior doorway moulding framework is arranged such that each side of the doorway is a mirror image of the other side, and the instant invention is designed to miter seamlessly on each side of the doorway with the contoured casing. In an exemplary embodiment, there are 90-degree mitered joints located on each side of the doorstop in the door jamb. Note that the door jamb standard is about 116 mm (4 9/16 inches) wide and that the flat side for the swinging door is a shorter length than the flat non-door side, which further necessitates that the doorway shoe moulding pieces comprising a kit or package are designed for one specific section of a doorway on either side (i.e., they are not interchangeable). This is another important feature considered by the instant invention described herein.

In the embodiments described here, a specific number of doorway shoe moulding pieces or components with defined break points are needed in a kit package in order to suit the mirror orientations and different dimensions for the two doorway moulding sides. A doorway shoe moulding assembly of the present invention may be configured to fit a variety of doorways including, but not limited to, swinging door doorways, wherein the jamb has a doorstop, an interior doorway with a continuous jamb, a pocket doorway and the interior side of an interior/exterior doorway. In an exemplary embodiment, a doorway shoe moulding assembly configured for a standard doorway with a swinging door, has a plurality of components which may be configured into assemblies, such as a casing assembly for each side of the doorway and a stop assembly. The preferred method has three pieces to finish each side per kit package plus spacers are provided for use when a non-standard (over-sized) doorway is encountered.

Common USA industry standard and profile coded shoe moulding is available in the form of quarter round dowel with the outside edge in convex form wherein each inside edge faces against the floor and baseboard in equal width or radius, as shown in FIG. 20 for depicted profiles and codes. These convex quarter round shoe mouldings typically come in sizes from 12.7 mm to 19 mm (½ inch to ¾ inch) in width on the flat edges.

In addition, other standard shoe moulding profile sizes are elliptical or quarter oval and are typically sized from 11 mm×19 mm (7/16 inch×¾ inch) and 12.7×19 mm (½ inch×¾ inch); see FIG. 20 for these profiles and codes. The 12.7×19 mm quarter elliptical shoe moulding (CM126) is most commonly used in the industry and the profiles depicted in FIG. 20 account for well over 95% of the USA building and remodeling industry.

In practice, the instant invention is designed to fit with convex quarter round and quarter elliptical mouldings in the range of 12.7×19 mm on the edges. In an exemplary embodiment, a doorway shoe moulding assembly will include components based on the contour-matched profiles shown in FIG. 20 that includes casing profiles with lengths of 57 mm and 63.5 mm (2¼ inch and 2½ inch).

As stated earlier, an exemplary doorway shoe moulding kit package is comprised of pieces based on a standard doorway that typically has a swinging door. A preferred doorway shoe moulding assembly has three pieces for each side of the doorway and one or more spacers to finish a non-standard door. Break points for the pieces based on the method occur at either the doorstop miters or the corner miter between the casing and door jamb. An exemplary doorway shoe moulding assembly for a pocket or sliding door are each described herein with a single method for the breakdown of kit package pieces, respectively.

It should be noted that flat edges of door jamb where a swinging door is typically installed with a general clearance height from the floor creates a more complicated situation for installing doorway shoe moulding. An exemplary shoe moulding assembly may include components that are tapered in height around the doorway so that along the door jamb clearance from the door is ensured. In addition, since there is some variability between the baseboard, shoe moulding along the baseboard, and the vertical casing, an exemplary doorway shoe moulding assembly may be designed so that the minor error differences are barely noticeable. Since the doorway shoe moulding will be produced with materials that are easily cut, filed and sanded, the instant invention can be easily and more precisely fitted by a builder if desired. The general height of the Doorway Shoe Moulding invention may be about 14 mm (9/16 inch) at the baseboard and taper down along the casing to no less than about 11 mm (7/16 inch), and then run straight across the door jamb at the lower height. This will ensure that the invention does not interfere with a door if installed.

An exemplary doorway shoe moulding assembly may include components that are relatively thin which may not be strong enough to allow for a nail or staple gun fastener to be used without damaging the components. Therefore, alternative attachment means may be used, including, but not limited to, fast-setting glue, epoxy, resins, caulking and other equal bonding means that are relatively permanent. Components of an exemplary doorway shoe moulding assembly may comprise small pre-drilled holes for small finishing nails or brads to be used to secure the pieces to the doorway components.

An exemplary shoe moulding assembly comprises moulding pieces in a kit that are contour-matched to a standard casing profiles and that have lengths that correspond to the standard door jambs. Some of the components, such as a jamb shoe moulding, may be tapered to allow clearance for a swinging door. The doorway shoe moulding pieces are configured and specific to each side of the doorway due to its mirror or opposite handing configuration and due to the fact that the flat door and non-door sections on either side of the doorstop of the door jamb are not of equal length.

The various disclosed embodiments of the instant invention demonstrate the following significant user advantages: 1) providing casing shoe moulding having a casing surface that matches the contours of casing, and/or assemblies for extending around a casing to the jamb of a door, and/or a stop assembly for extending around a doorstop; 2) providing a pleasing, aesthetic, finished doorway appearance at a relatively low cost; 3) providing a doorway without gaps between the jamb or casing and the floor, thereby making it easier to clean and preventing dirt, debris, and insects from collecting or harboring in the gaps; 4) providing a packaged kit that will accommodate over 95% of the standard shoe mouldings used in the industry, which includes the quarter round and quarter elliptical profiles; 5) providing a doorway shoe moulding assembly made with a variety of materials as other moulding producers including finished or unfinished solid wood, finger jointed wood trim, medium density fiberboard (MDF), wood composite, and polymer-based composite materials such Polyvinyl Chloride (PVC) and nylon; 6) providing a doorway shoe moulding assembly that is made from materials that allow for easy cutting, sanding or filing to create a best fit during installation, depending on the material, the instant invention shall also be readily painted, or stained and finished as when solid or composite wood, plastic or foam materials are used; 7) providing a doorway shoe moulding assembly that is manufactured by similar techniques as is used by current manufacturers of moulding products such as by milling (CNC cutting), pressure forming, injection molds, and even 3D printing for special order kit packages; 8) providing a doorway shoe moulding assembly that is simple, easy and relatively quick to install by skilled and unskilled user; the preferred method for installation shall be by fast-setting glue or epoxy resins, although other conventional methods such as nails may be possible; 9) providing a doorway shoe moulding assembly that is defined by standard dimensions and industry profile codes will identify the casing profile to which the pieces are contour-matched. However, for standard doorways and pocket or sliding doors, two spacers will be provided for users to complete a wider non-standard doorway.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
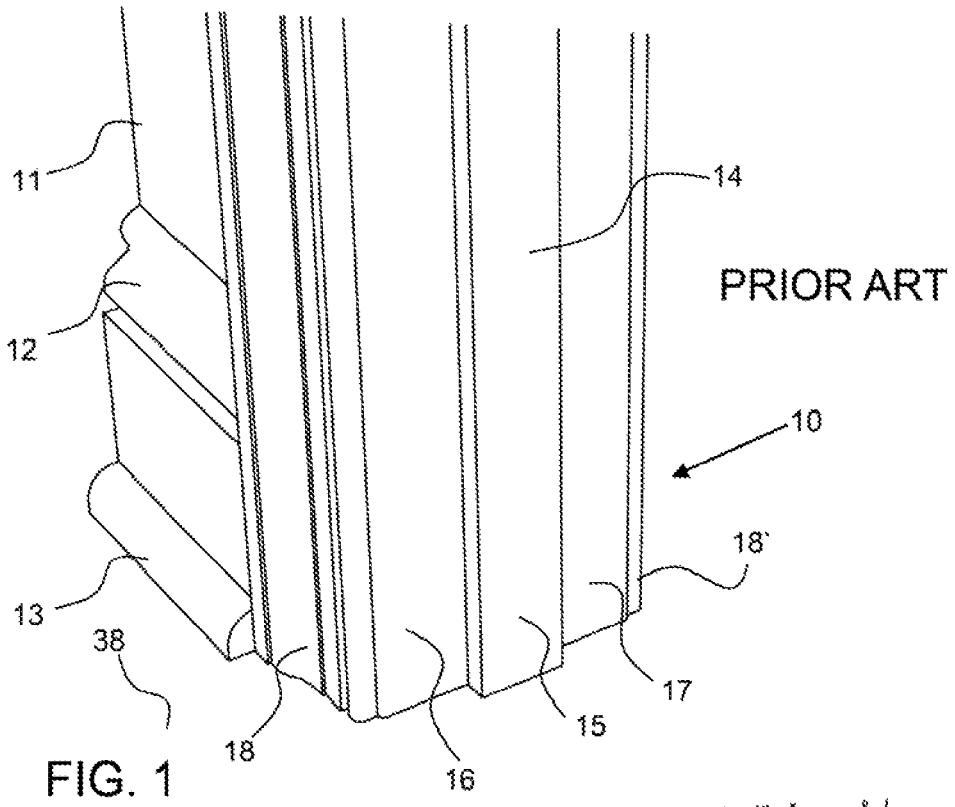
FIGS. 1 and 2 show perspective views of a conventional interior doorway having casing on either side of the doorway and a rectangular doorstop extending vertically along the doorjamb.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Figure 2:
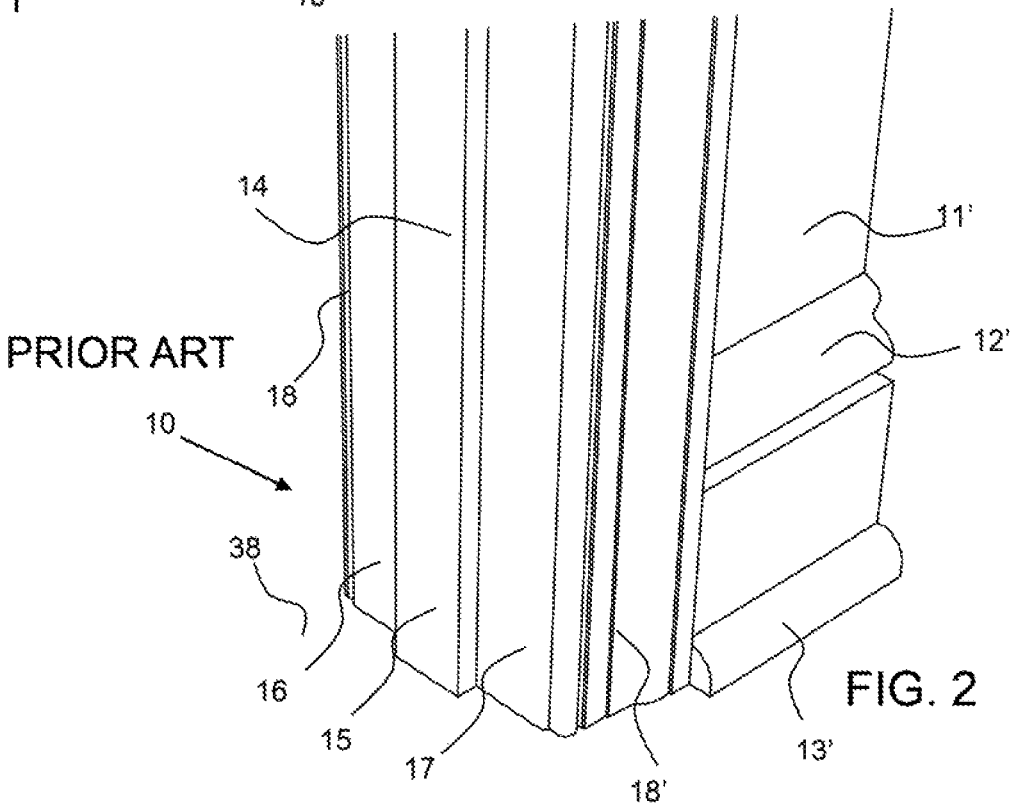

As shown in FIGS. 1 and 2, a conventional interior doorway 10 has casing 18, 18' on either side of the jamb 14 of the doorway and a rectangular doorstop 15 extending vertically along the doorjamb. The doorstop produces a first jamb portion 16 and second jamb portion 17 of the doorjamb. The wall shoe mouldings 13, 13' extend along the corresponding baseboards 12, 12' to close any gaps between the baseboard and the floor 38. The baseboards 12, 12' and wall shoe mouldings 13, 13' extend along opposing walls 11, 11' respectively.

Referring to FIGS. 3 to 18, the doorway shoe mouldings and/or assemblies may be provided as a kit 71 that may include one or more spacers to accommodate various sizes of doorways. Referring to FIGS. 3 to 18, the casing shoe moulding 78 on the first side of the doorway, or along the first casing 18, has a casing surface 90 that is a mirror image of the casing surface 90' on the second casing shoe moulding 78'.

Figure 3:
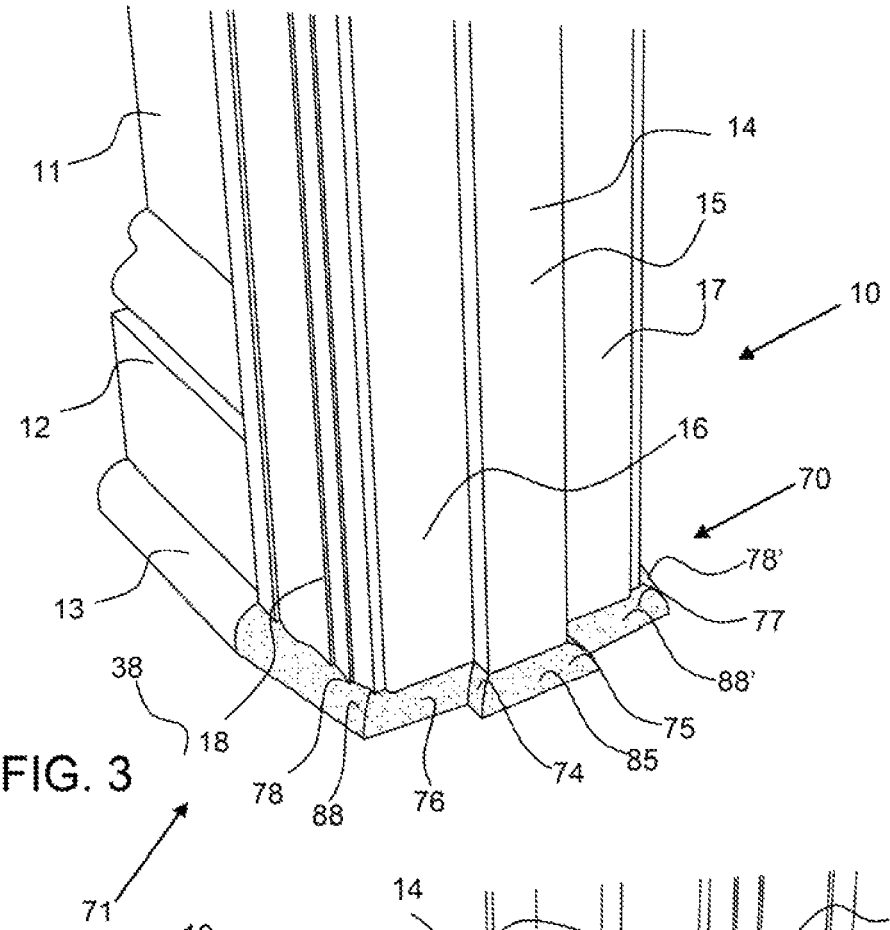
FIGS. 3 and 4 show the conventional interior doorway shown in FIGS. 1 and 2 with an exemplary doorway shoe moulding assembly extending around the doorway to produce an aesthetically appealing finish between the doorway and the floor.
Figure 4:
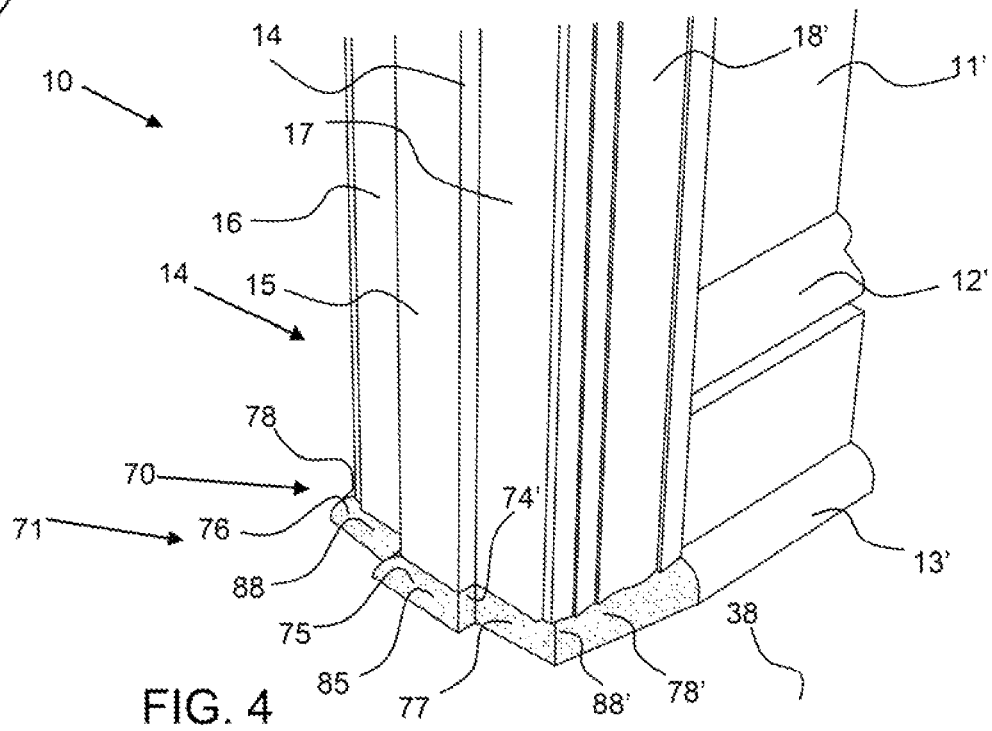

Referring now to FIGS. 3 and 4, the conventional interior doorway 10 shown in FIGS. 1 and 2 is now fitted with an exemplary doorway shoe moulding assembly 70 extending around the doorway to produce an aesthetically appealing finish between the doorway and the floor 38. The exemplary doorway shoe moulding assembly comprises a first casing shoe moulding 78 and a second casing shoe moulding 78' that extend along the opposing casings 18, 18', respectively, from a wall end to a doorway end. The first casing shoe moulding 78 couples with a first jamb shoe moulding 76 and the second casing shoe moulding 78' couples with a second jamb shoe moulding 77. Configured between the first and second jamb shoe mouldings in a stop shoe moulding 75 with two side stop shoe mouldings 74, 74', configured on opposing sides to cover the doorstop. The stop shoe moulding and two side stop shoe mouldings may be configured as a stop assembly 85, wherein these components are attached together in a one-piece unit for ease of installation. Likewise, the casing shoe moulding and the corresponding jamb shoe mouldings may be configured as a casing assembly 88, wherein these components are attached together in a one-piece unit for ease of installation.

Figure 5:
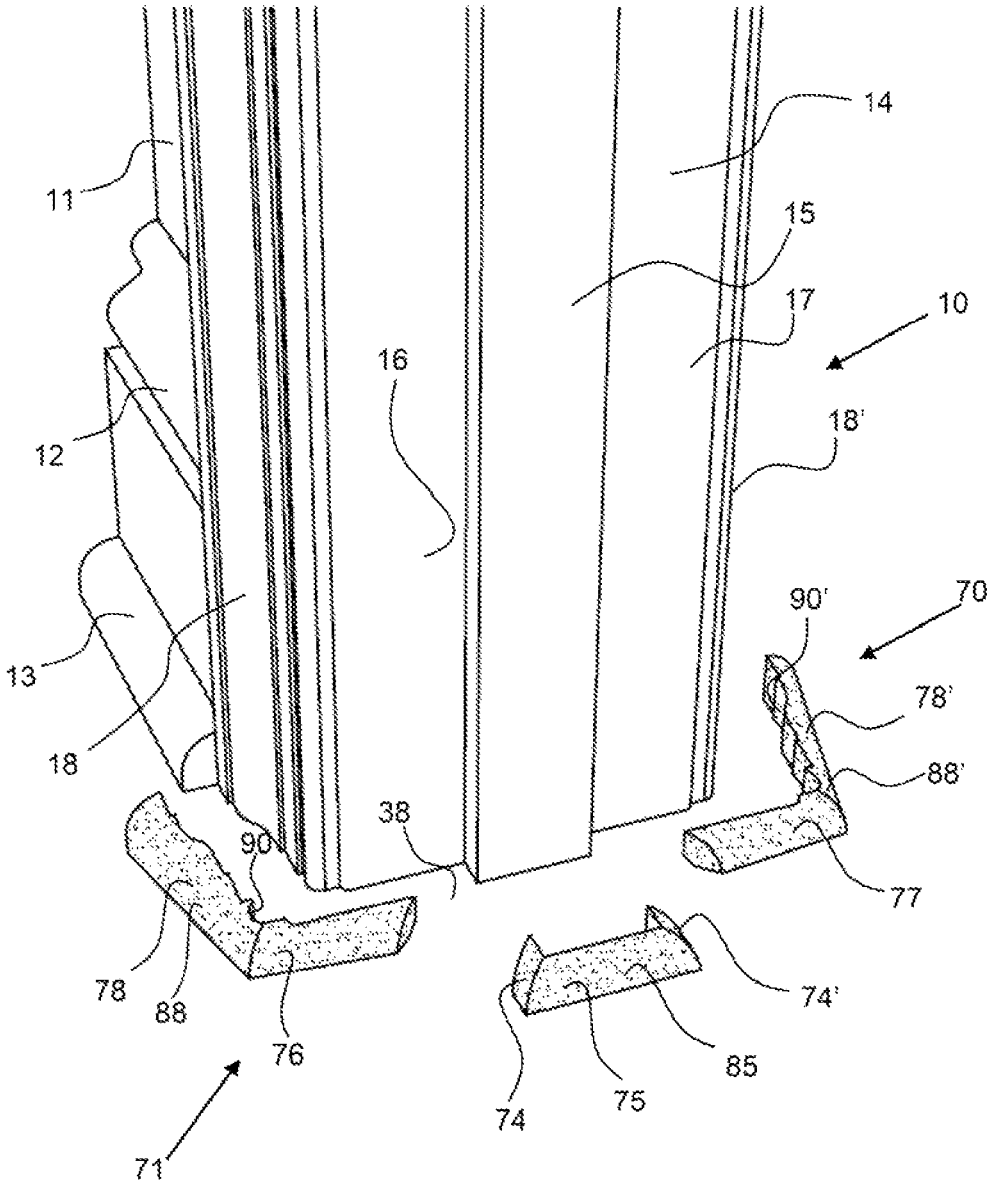
FIG. 5 shows a perspective view of a conventional interior doorway and an exemplary doorway shoe moulding assembly comprising a casing assembly and a stop assembly placed along the doorway for quick and easy installation.

As shown in FIG. 5, an exemplary doorway shoe moulding assembly 70 comprises three pieces including two casing assemblies and a stop assembly. The assemblies are placed around the standard doorway 10 and enable quick installation.

Figure 6:
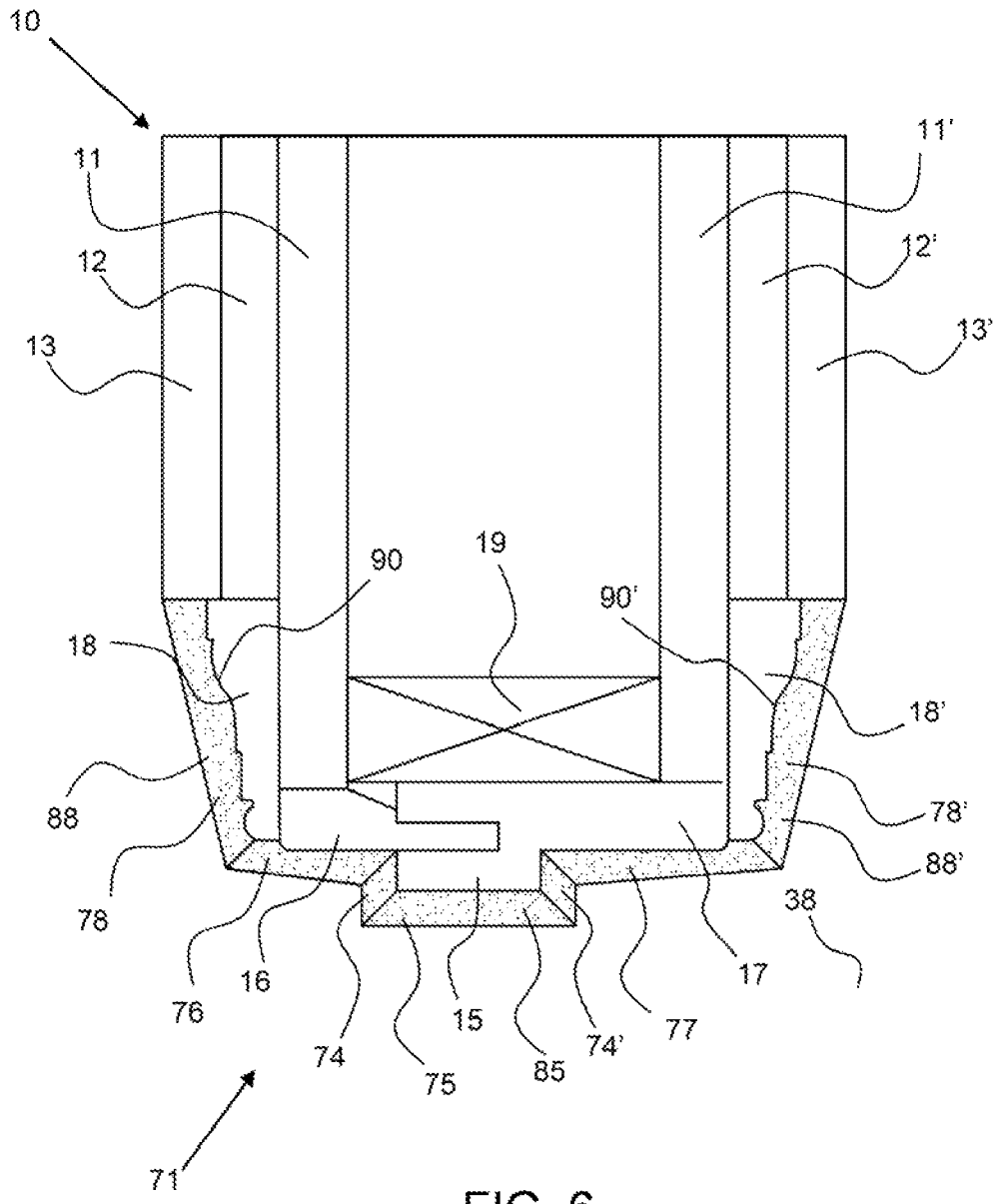
FIG. 6 shows a top view of an exemplary doorway shoe moulding assembly as shown in FIGS. 3 and 4 configured around a conventional interior doorway.

As shown in FIG. 6, the exemplary doorway shoe moulding assembly 70 is configured around a conventional interior doorway 10 and produces a tight fit around the doorway. The casing shoe mouldings 18, 18' have a casing surface 90 that is contoured to match the contours of the casing. The casing surface produces an aesthetically appealing interface between the casing shoe moulding and the casing. The inside framing 19 of the doorway is shown in FIG. 6.

Figure 7:
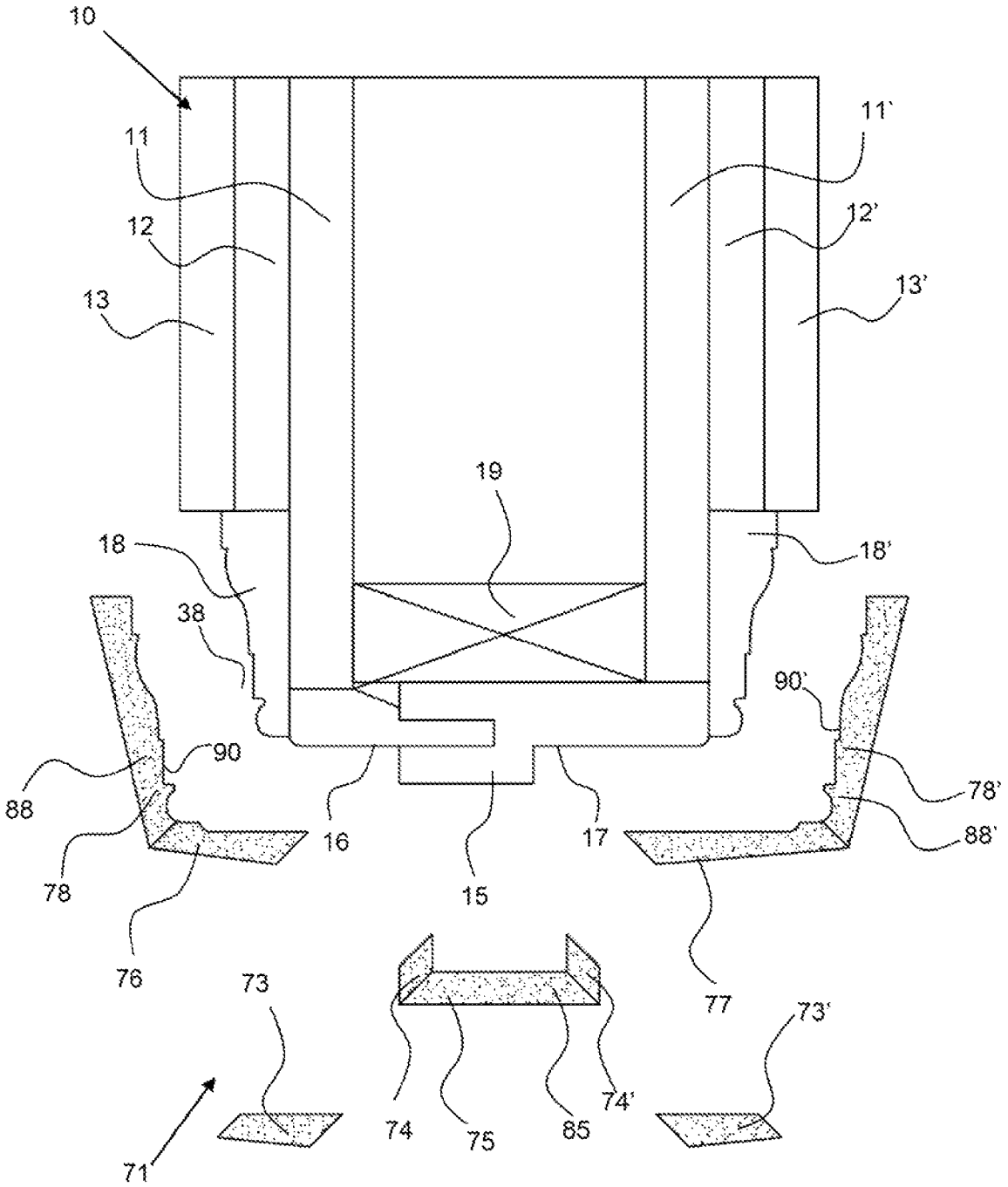
FIG. 7 shows a top view of an exemplary doorway shoe moulding assembly, as shown in FIG. 5 configured around a conventional interior doorway.

As shown in FIG. 7, an exemplary doorway shoe moulding assembly 70 comprises two casing assemblies 88, 88', a stop assembly 85 and a plurality of spacer shoe mouldings 73, 73' configured to extend between the stop assemblies and the casing assemblies. An exemplary doorway shoe moulding assembly may include a plurality of spacers of different lengths to enable a user to select an appropriately sized spacer for the doorway.

Figure 8:
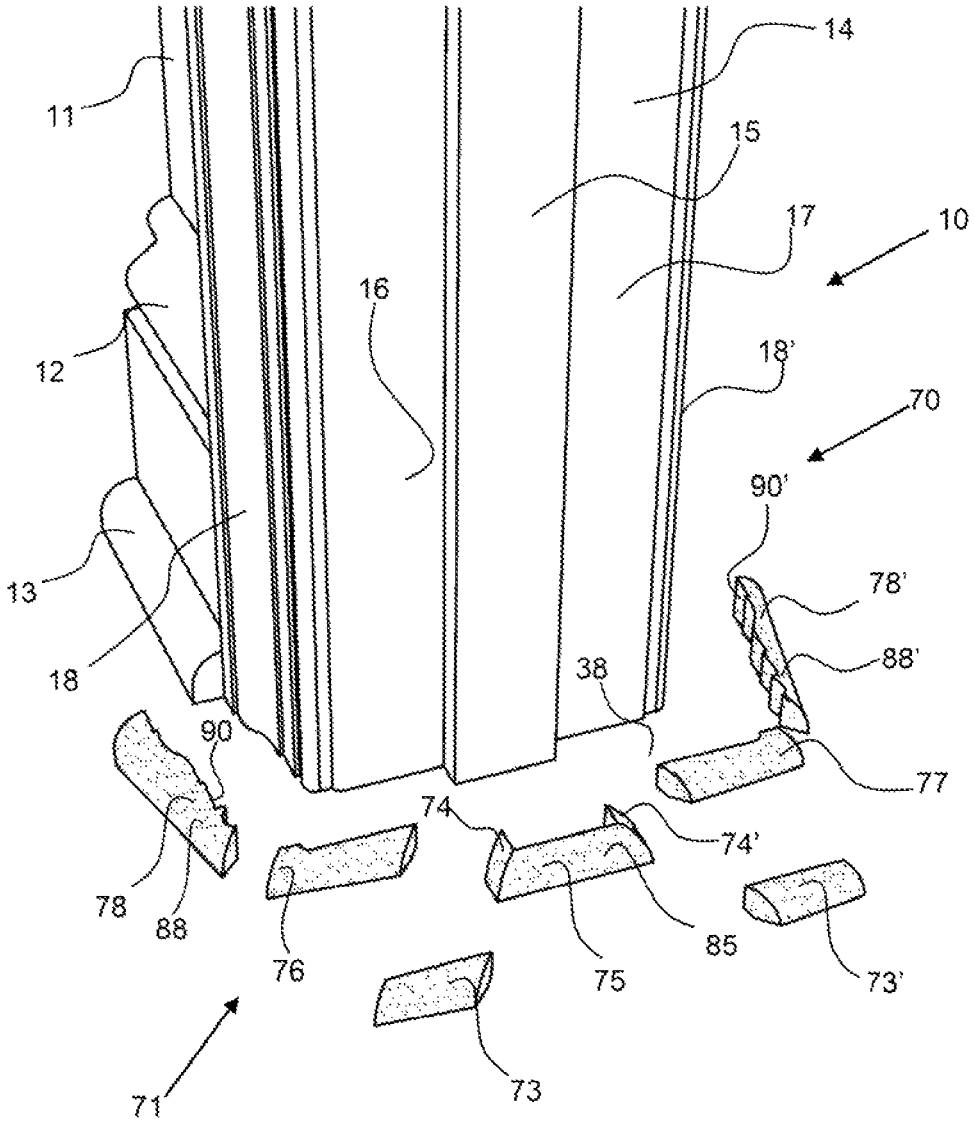
FIG. 8 shows a perspective view of a conventional interior doorway and an exemplary doorway shoe moulding assembly placed along the doorway for quick and easy installation.
Figure 9:
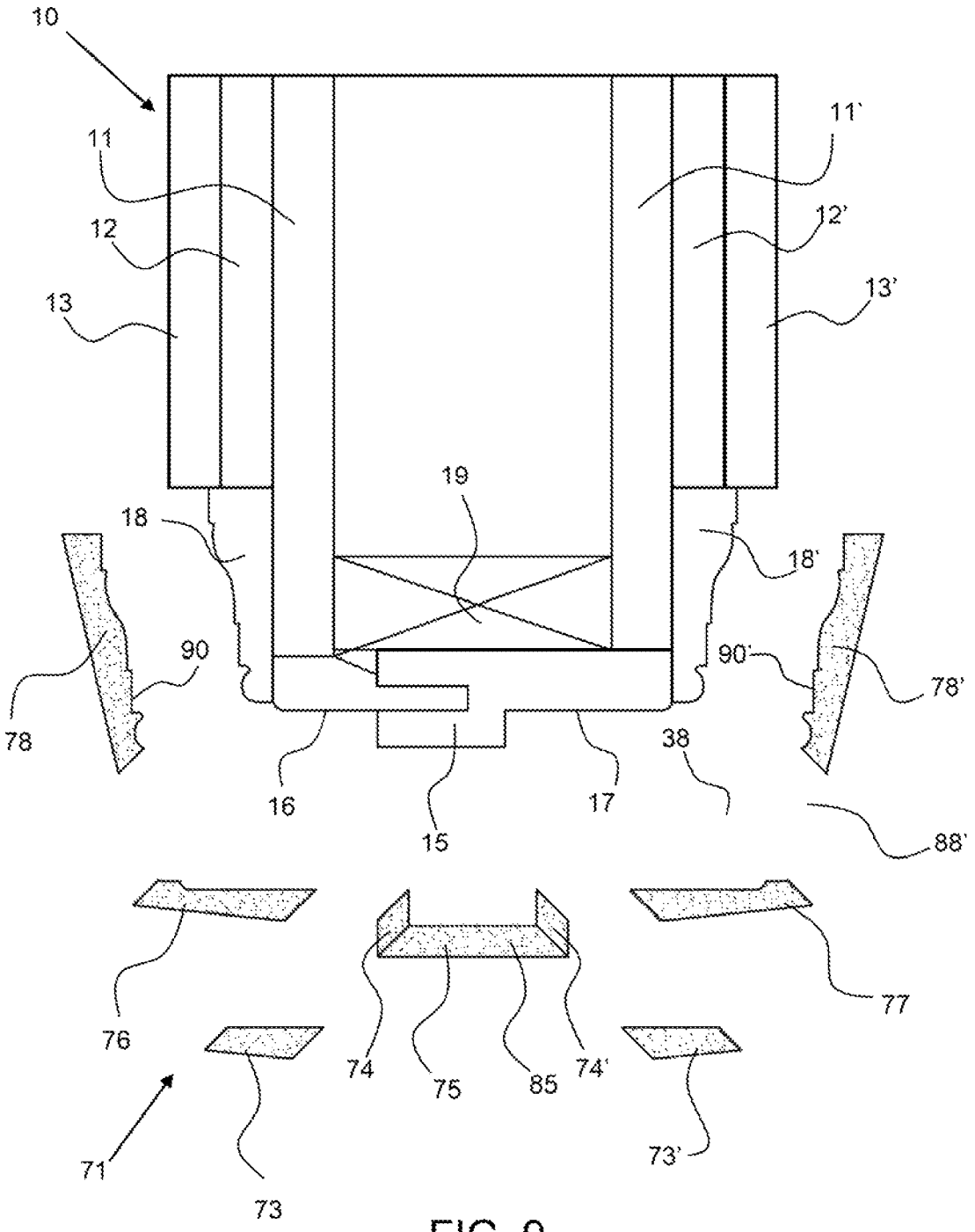
FIG. 9 shows a top view of the exemplary doorway shoe moulding assembly shown in FIG. 8 having a plurality of shoe moulding pieces configured around a conventional interior doorway.

Referring to FIGS. 8 and 9, an exemplary doorway shoe moulding assembly 70 comprises a stop assembly 85, two casing shoe mouldings 78, 78', a first jamb shoe moulding 76, a second jamb shoe moulding 77, and a plurality of spacer shoe mouldings 73, 73'. The casing surfaces 90, 90' have a contoured shape corresponding with the contoured surface of the casings 18, 18'.

Figure 10:
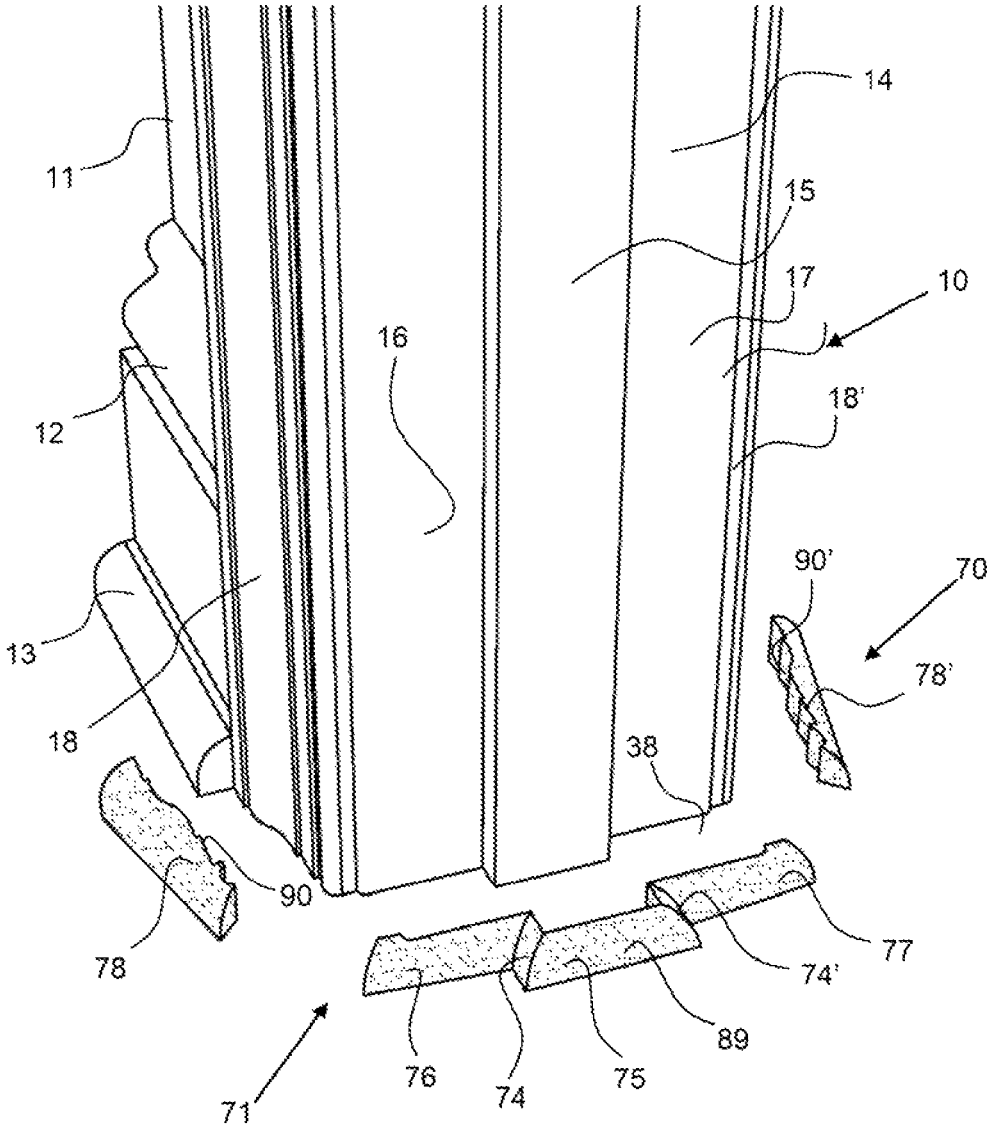
FIG. 10 shows a perspective view of a conventional interior doorway and an exemplary doorway shoe moulding assembly comprising a stop assembly placed along the doorway for quick and easy installation.

As shown in FIG. 10, an exemplary doorway shoe moulding assembly 70 comprises a jamb assembly 89 that comprises a stop assembly 85 attached to a first jamb shoe moulding 76 and a second jamb shoe moulding 77 in a one-piece unit. The exemplary doorway shoe moulding assembly 70 comprises only three pieces, the jamb assembly 89 and two casing shoe mouldings 78, 78'. This exemplary doorway shoe moulding assembly 70 enables quick installation around an interior doorway and the jamb assembly may enable a user to pick casing shoe mouldings that match their particular casing for attachment with the more universal jamb assembly.

Figure 11:
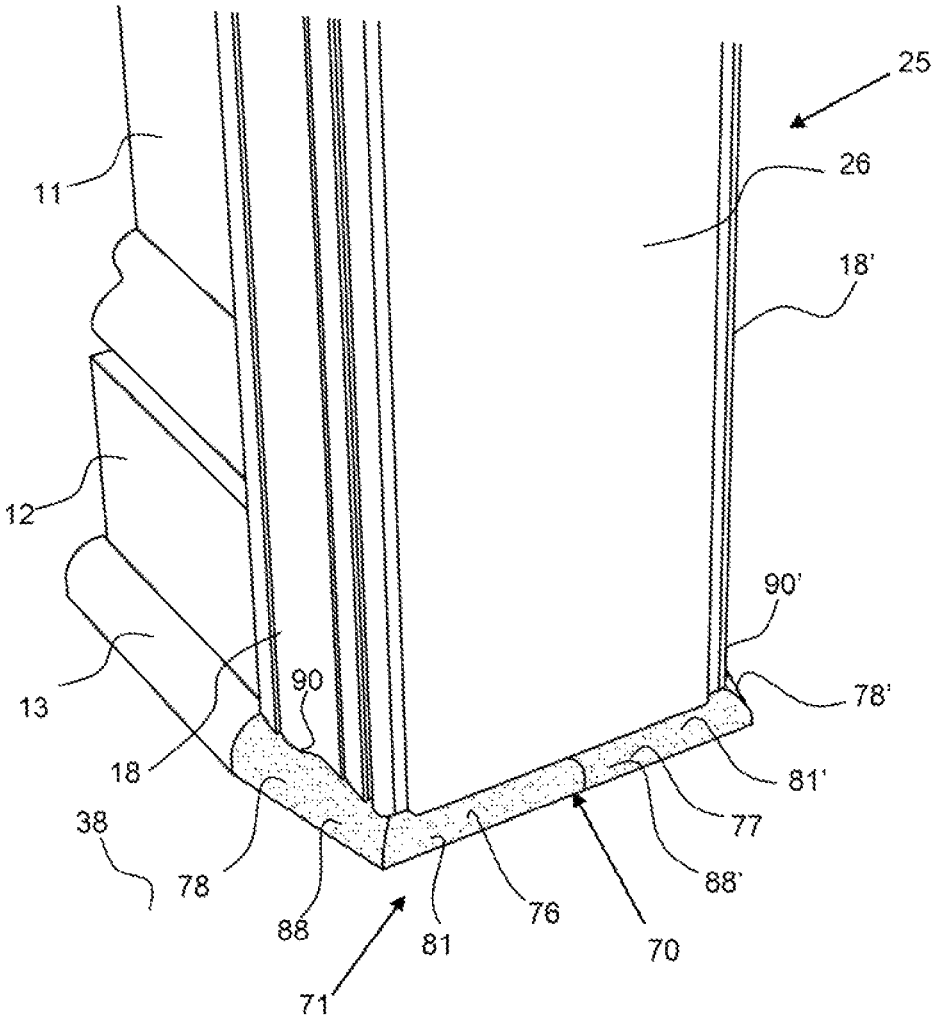
FIG. 11 shows a perspective view of a conventional interior doorway without a doorstop and an exemplary doorway shoe moulding assembly coupled to and extending around the doorway to produce an aesthetically appealing finish between the doorway and the floor.
Figure 12:
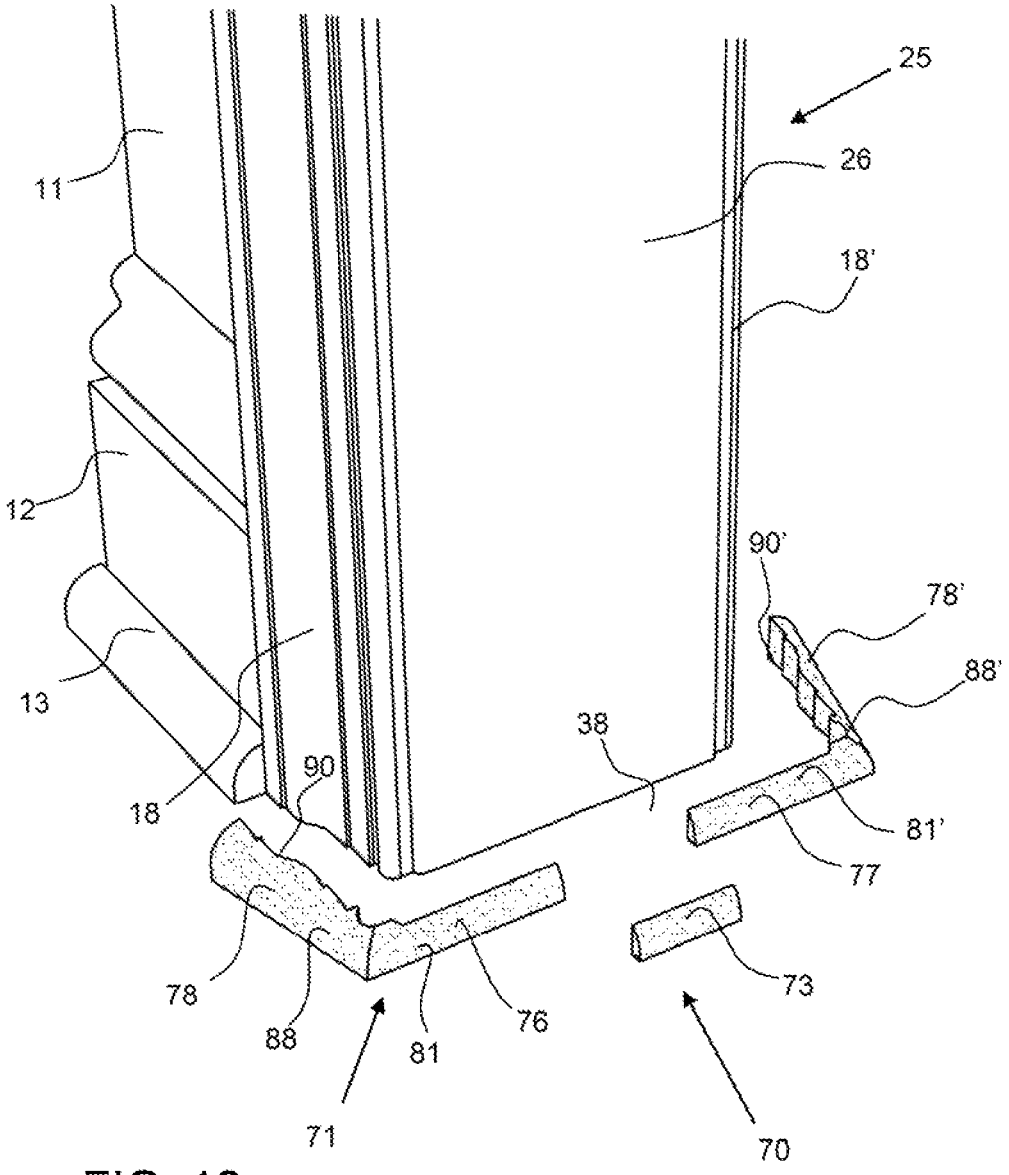
FIG. 12 shows a perspective view of a conventional interior doorway without a doorstop and an exemplary doorway shoe moulding assembly comprising casing assemblies and a spacer shoe moulding placed around the doorway for quick and easy installation.
Figure 13:
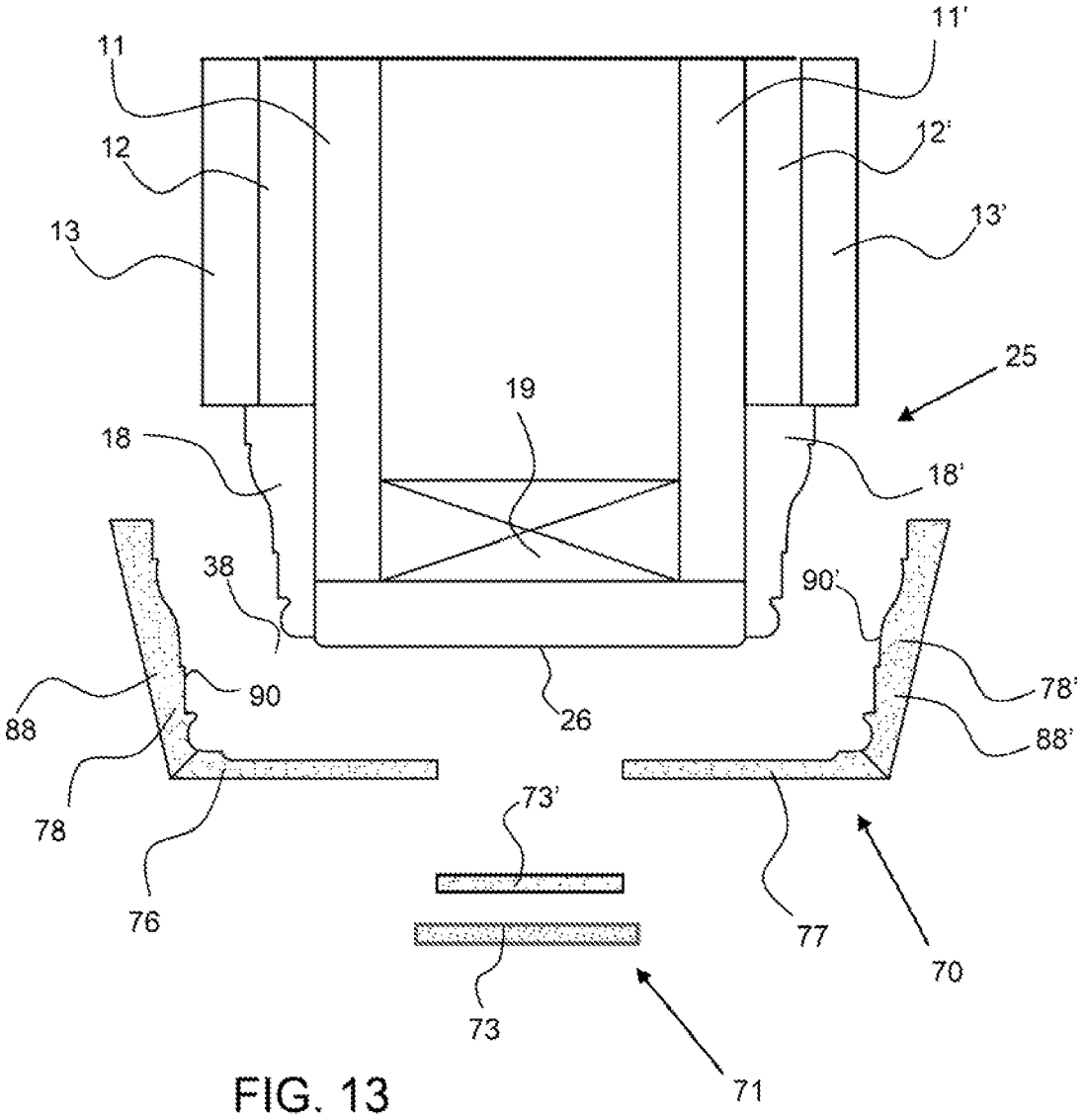
FIG. 13 shows a top view of the conventional interior doorway without a doorstop as shown in FIG. 12 with an exemplary doorway shoe moulding assembly comprising casing assemblies and a plurality of spacer shoe mouldings placed around the doorway for quick and easy installation.

Referring to FIGS. 11 to 13, an exemplary continuous jamb doorway 25 has a flat and continuous jamb 26 without a doorstop. As shown in FIG. 11 two casing assemblies 88 and 88' may be configured to extend around the doorway to produce a continuous shoe moulding around the doorway. The two extended ends of the first and second jamb shoe mouldings 76 and 77 of the casing assemblies may be configured to abut as shown in FIG. 11. As shown in FIG. 12, a spacer shoe moulding 73 may be configured to extend between the two extended ends of the first and second jamb shoe mouldings. As shown in FIG. 13, an exemplary doorway shoe moulding assembly 70 may be provided as a kit 71 having a plurality of spacer shoe mouldings 73, 73' which may be different lengths to accommodate various widths and gaps between the other jamb shoe moulding or stop components, for example.

Figure 14:
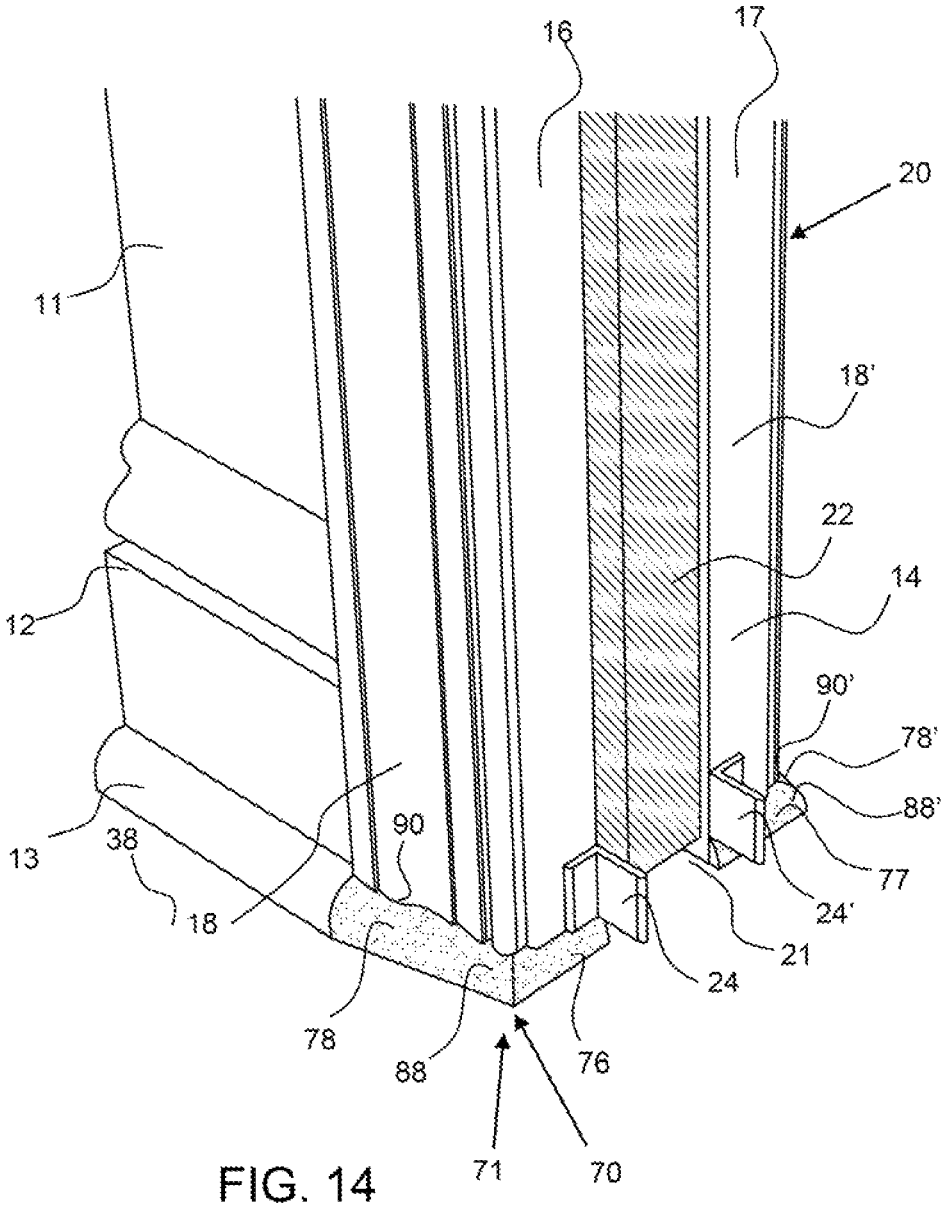
FIG. 14 shows a perspective view of a pocket doorway having an exemplary doorway shoe moulding assembly extending around the doorway to the pocket door opening.
Figure 15:
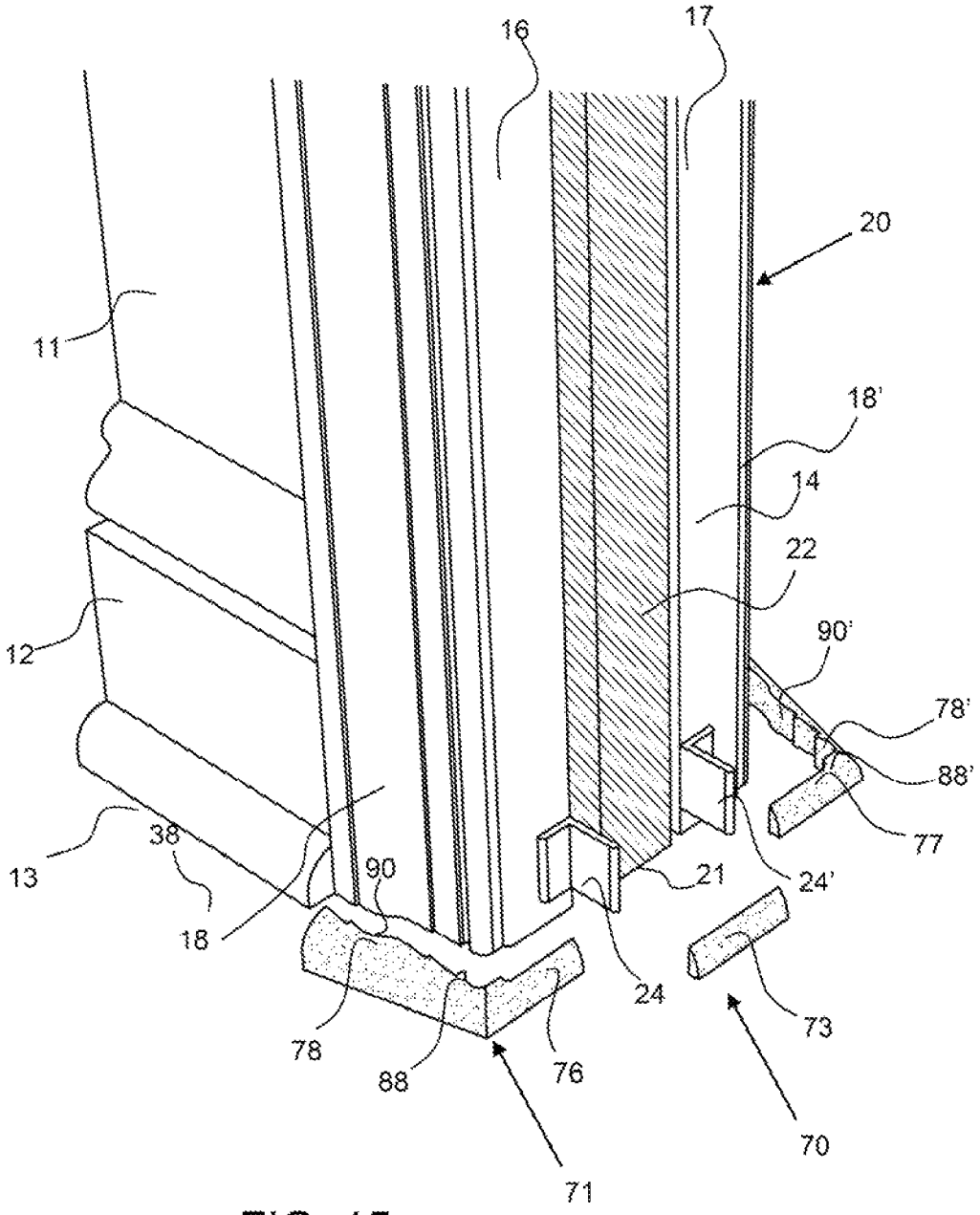
FIG. 15 shows a perspective view of the pocket doorway shown in FIG. 14, having an exemplary doorway shoe moulding assembly placed around the doorway and comprising a spacer shoe moulding for extending along the pocket door opening.
Figure 16:
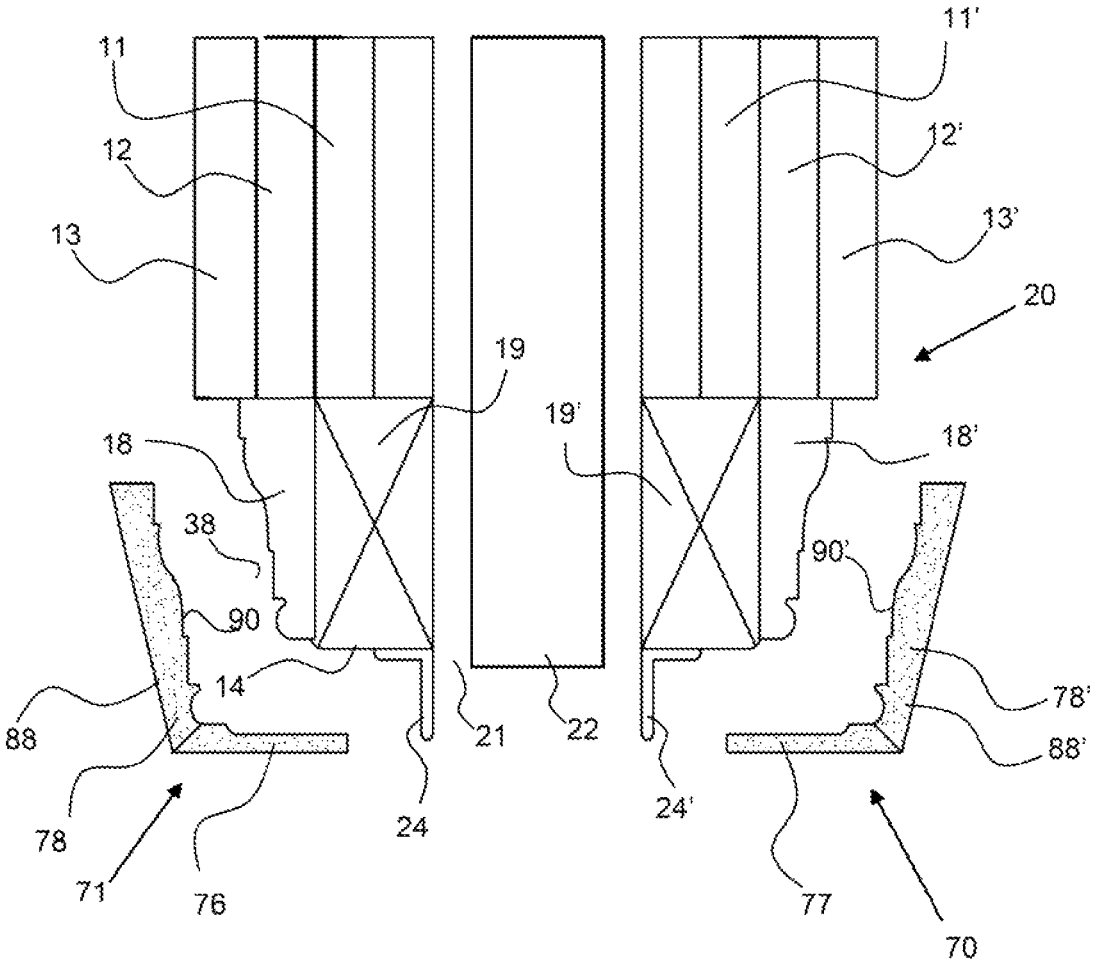
FIG. 16 shows a top view of the of the pocket doorway shown in FIGS. 14 and 15, having an exemplary doorway shoe moulding assembly placed around the doorway for quick and easy installation.

Referring now to FIGS. 14 to 16, an exemplary pocket doorway 20 comprises a pocket door opening 21 for a pocket door 22 to slide in and out of the wall 11. A pair of shims 24, 24' may be configured along the jamb 14 to guide the door in and out. As shown in FIG. 14, the exemplary doorway shoe moulding assembly 70 comprises a pair of casing shoe mouldings 78, 78' and a pair of jamb shoe mouldings 76, 77. The jamb shoe mouldings may have specific contours to interface with or terminate with the pocket door opening or shims. As shown in FIG. 15, a spacer shoe moulding 73 is configured to extend along the pocket door opening 21 and between the first and second jamb shoe mouldings and may be shorter in height to allow clearance under the door. As shown in FIG. 16, the pocket doorway shoe moulding assembly 70 comprise only two pieces, a first casing assembly 88 and a second casing assembly 88'.

Figure 17:
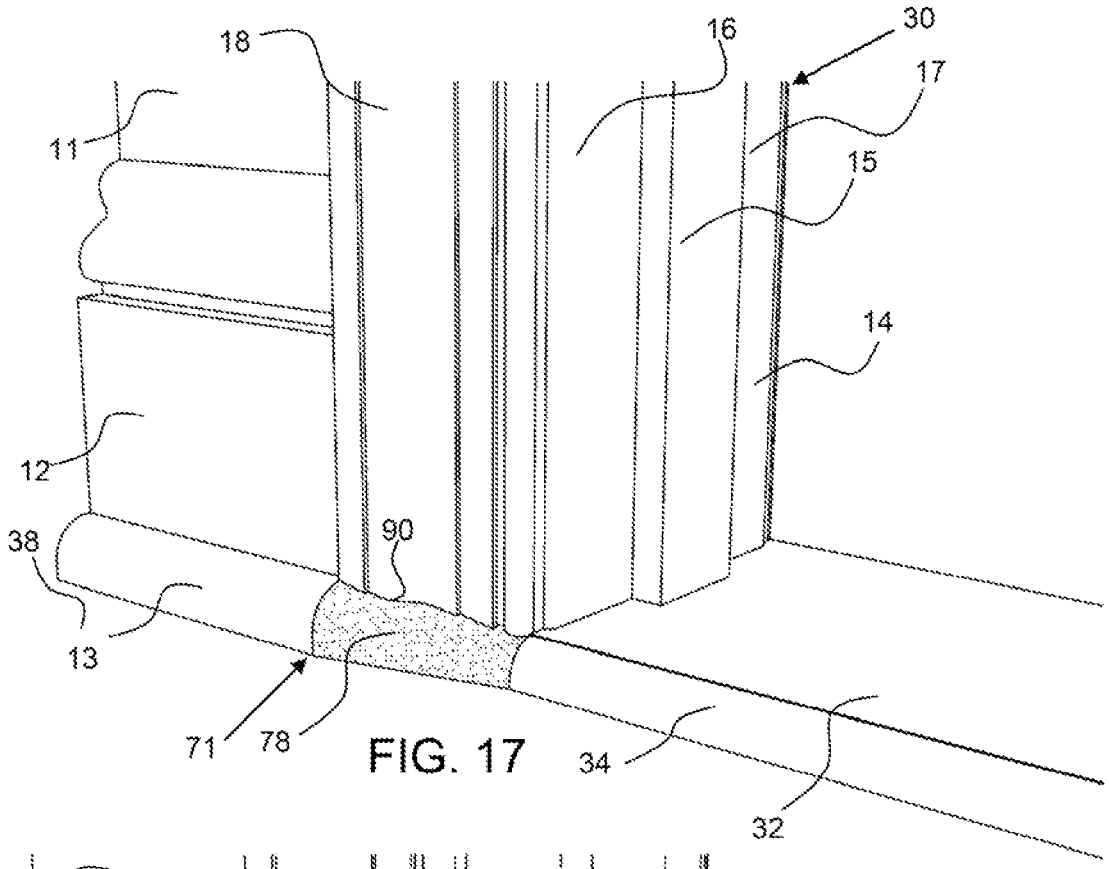
FIG. 17 shows a perspective view of an exemplary exterior doorway having a threshold extending from the jamb of the doorway and a casing shoe moulding extending along the casing from the threshold to the wall on the interior side of the doorway.
Figure 18:
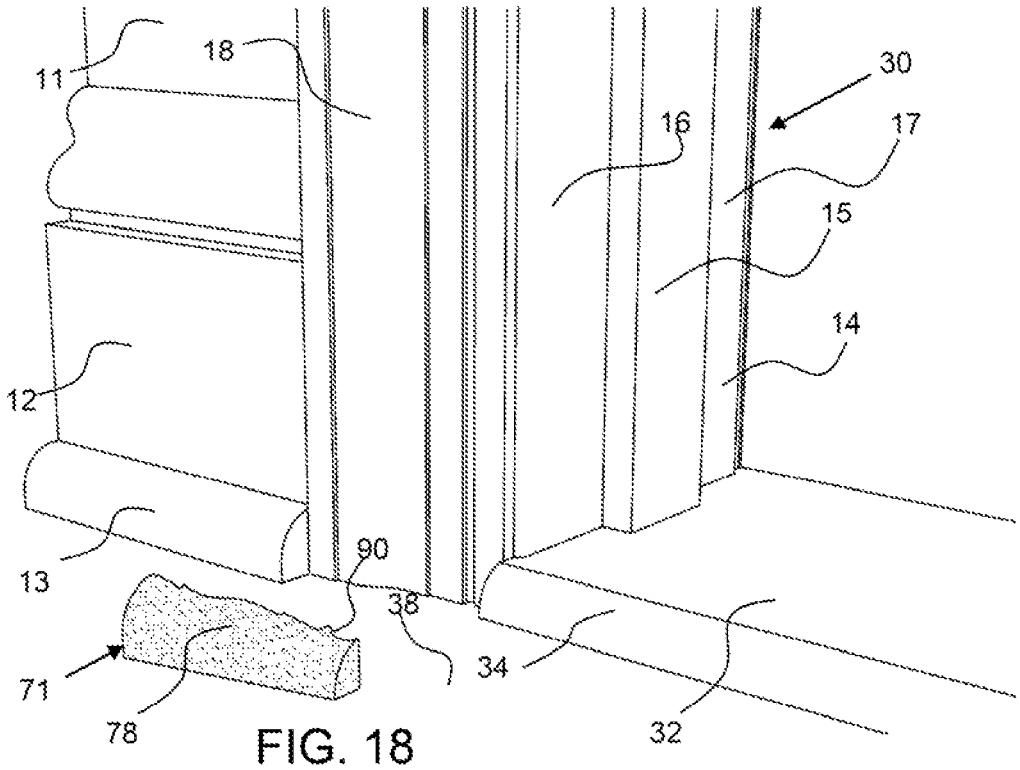
FIG. 18 shows a perspective view of the doorway shown in FIG. 17 with the casing shoe moulding placed along the casing for quick and easy installation.

Referring now to FIGS. 17 and 18, an exemplary exterior doorway 30 comprising a threshold 32 extending from the jamb 14 of the doorway. A shoe moulding 34 may extend along the jamb as shown. A casing shoe moulding 78 extends between the threshold and shoe moulding along the threshold to the shoe moulding 13 extending along the wall 11. The casing shoe moulding has a casing surface that matches the contours of the casing 18.

Figure 19:
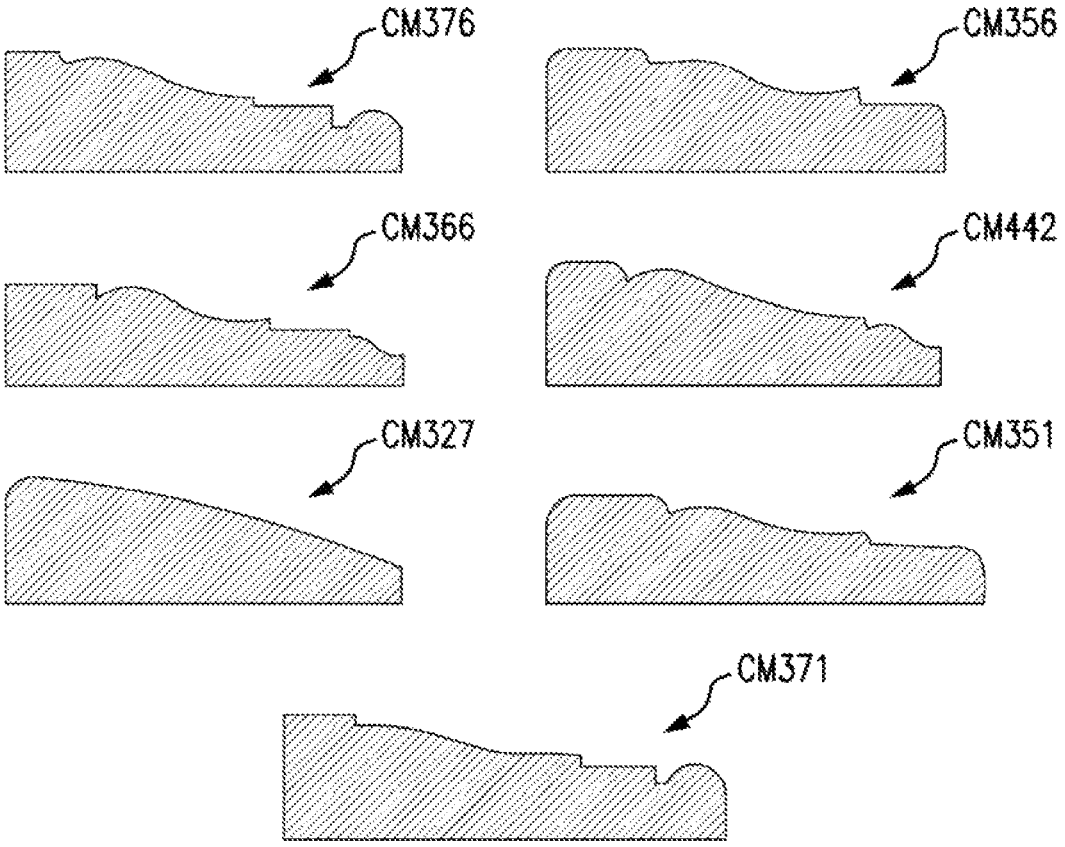
FIG. 19 shows cross sectional views of a plurality of casings having a contoured surface including curves and straight edges.

As shown in FIG. 19, casings CM376, CM366, CM327, CM356, CM442, CM351 and CM371 have various standardized shapes and contours.

Figure 20:
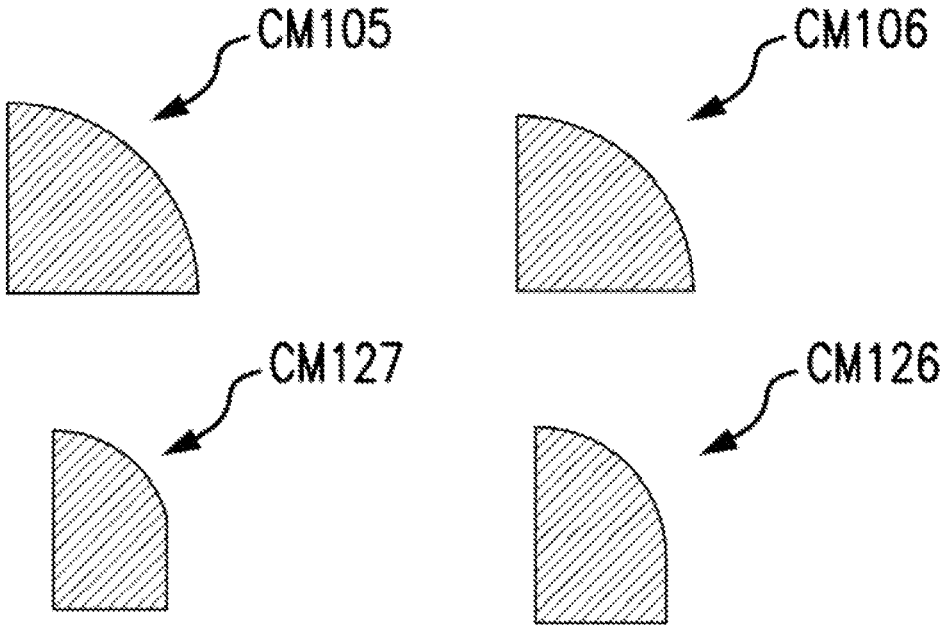
FIG. 20 shows cross sectional views of exemplary shoe mouldings.

As shown in FIG. 20, shoe mouldings CM105, CM106, CM127 and CM126 have various contours.

Corresponding reference characters indicate corresponding parts. It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A doorway shoe moulding assembly comprising:

a) a first casing shoe moulding comprising a first casing surface that is contoured to match a casing along a doorway;

b) a second casing shoe moulding;

wherein the second casing shoe mouldings comprises a second casing surface that is contoured to match a second casing along a doorway; and wherein the second casing surface is a mirror surface of the first casing surface;

c) a jamb moulding; and wherein the jamb moulding extends between the first and second casing shoe mouldings to produce a continuous shoe moulding around the doorway;

wherein the jamb moulding comprises a first jamb shoe moulding and a second jamb shoe moulding, and wherein the first and second jamb shoe mouldings extend along a jamb to produce a continuous shoe moulding along the jamb of the doorway;

wherein the first casing shoe moulding and the first jamb shoe moulding are coupled together in a first casing assembly, wherein the second casing shoe moulding and the second jamb shoe moulding are coupled together in a second casing assembly, d) a spacer shoe moulding that is configured between the first and second jamb shoe mouldings to produce a continuous shoe moulding along the jamb of the doorway.

2. The doorway shoe moulding assembly of claim 1, further comprising a stop assembly comprising a stop shoe moulding and two side stop shoe mouldings that extend orthogonally from extended ends of the stop shoe moulding and around sides of a doorstop of the doorway to produce a continuous shoe moulding around the doorstop; and wherein the stop shoe moulding and two side stop shoe mouldings are attached together to form said stop assembly.

3. A doorway shoe moulding assembly comprising:

a) a first casing shoe moulding comprising a first casing surface that is contoured to match a casing along a doorway;

b) a second casing shoe moulding;

wherein the second shoe moulding comprises a second casing surface that is contoured to match a second casing along a doorway; and wherein the second casing surface is a mirror surface of the first casing surface;

c) a first jamb moulding;

d) a second jamb moulding;

wherein the doorway is a pocket door doorway having a pocket door opening; and wherein the first jamb moulding extends between the first casing moulding and the pocket door opening, and wherein the second jamb moulding extends between the second casing moulding and pocket door opening to produce a continuous shoe moulding around the doorway to the pocket door opening.

4. The doorway shoe moulding assembly of claim 3, wherein the first casing shoe moulding and the first jamb shoe moulding are coupled together in a first casing assembly.

5. The doorway shoe moulding assembly of claim 4, wherein the second casing shoe moulding and the second jamb shoe moulding are coupled together in a second a casing assembly.

6. The doorway shoe moulding assembly of claim 5, further comprising a jamb spacer shoe moulding configured to fit along the pocket door opening and between the first and second jamb shoe mouldings to produce a continuous shoe moulding around the pocket door doorway.

7. The doorway shoe moulding assembly of claim 3, further comprising a jamb spacer shoe moulding configured to fit along the pocket door opening and between the first and second jamb shoe mouldings to produce a continuous shoe moulding around the pocket door doorway.

8. The doorway shoe moulding assembly of claim 1, wherein the doorway is an interior/exterior doorway.

9. A doorway shoe moulding assembly consisting of:

a) a first casing assembly comprising:

i) a first casing shoe moulding comprising a first casing surface that is contoured to match a first casing along a doorway;

ii) a first jamb shoe moulding;

wherein the first casing shoe moulding and the first jamb shoe moulding are attached together;

b) a second casing assembly comprising:

i) a second casing shoe moulding comprising a second casing surface that is contoured to match a second casing along said doorway;

ii) a second jamb shoe moulding;

wherein the second casing surface is a mirror surface of the first casing surface; and wherein the second casing shoe moulding and the second jamb shoe moulding are attached together c) a stop shoe moulding assembly comprising a stop shoe moulding and two side stop shoe mouldings that extend orthogonally from extended ends of the stop shoe moulding and around sides of a doorstop of the doorway to produce a continuous shoe moulding around the doorstop;

wherein the stop shoe moulding and two side stop shoe mouldings are attached together;

d) a spacer shoe moulding that is configured for insertion between the first casing assembly and the stop shoe moulding assembly to produce a continuous shoe moulding along the jamb of the doorway; and wherein the first and second casing assemblies the stop shoe moulding assembly and the spacer shoe moulding are configured to produce a continuous shoe moulding around the doorway.

* * * * *